US005387488A

United States Patent [19]

Kaneko et al.

[11] Patent Number: 5,387,488

[45] Date of Patent: Feb. 7, 1995

[54] TONER FOR DEVELOPING LATENT ELECTROSTATIC IMAGES

[75] Inventors: Yoshikazu Kaneko, Numazu; Takayuki Hoshina, Fuji, both of Japan

[73] Assignee: Ricoh Company, Ltd., Tokyo, Japan

[21] Appl. No.: 39,798

[22] Filed: Mar. 30, 1993

[30] Foreign Application Priority Data

May 15, 1992 [JP] Japan ..... 4-148489

[51] Int. Cl.[6] ..... G03G 9/09

[52] U.S. Cl. ..... 430/106; 430/109; 430/111

[58] Field of Search ..... 430/106, 110, 109, 111

[56] References Cited

U.S. PATENT DOCUMENTS 3,933,664 1/1976 Nagashima et al. ..... 430/109

4,681,829 7/1987 Grushkin ..... 430/109

*Primary Examiner*—John Goodrow

*Attorney, Agent, or Firm*—Oblon, Spivak, McClelland, Maier, & Neustadt

[57] ABSTRACT

A toner for developing latent electrostatic images to visible toner images, composed of toner particles containing a thermoplastic resin and a compound with formula (I) or a compound with formula (II) serving as a coloring agent:

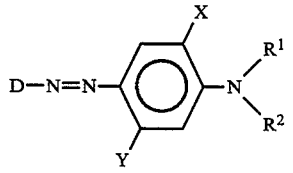

(I)

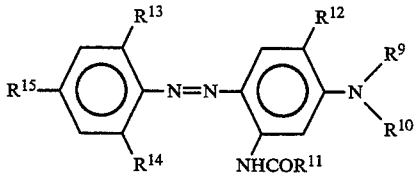

(II)

The toner particles may be composed of thermoplastic resin particles which are dyed with one of the compounds (I) or (II) serving as a coloring agent.

16 Claims, No Drawings

TONER FOR DEVELOPING LATENT ELECTROSTATIC IMAGES

BACKGROUND OF THE INVENTION

1. Field of the Invention

The present invention relates to a toner for developing latent electrostatic images to visible toner images in the fields of electrophotography and electrostatic recording, and more particularly to a toner comprising a thermoplastic resin and a coloring agent.

2. Discussion of Background

Because of a recent demand for images with high quality and high durability in electrophotographic systems, it is required that toner particles be minimized in size, and have a sharp particle size distribution, high coloring performance, and uniform charge control performance. A conventional toner for developing electrostatic images in visible toner images is usually produced by fusing and kneading a mixture of a thermoplastic resin and a coloring agent, pulverizing the kneaded mixture, and classifying the pulverized mixture. If toner particles having small particle sizes with a narrow particle size distribution is selectively obtained from the toner produced by the above method, the production performance and yield are significantly decreased, and the cost of such a toner is unquestionably high. Furthermore, the smaller the particle size, the less uniform the dispersion of a coloring agent and a charge controlling agent contained in the toner, and the more frequently the improper charging of the toner occurs. The toner particles obtained by pulverising have many protrusions on the surfaces thereof, so that such toner particles tend to be fused and adhere to the surfaces of carrier particles and also to the surface of a toner layer thickness regulating member. Furthermore, an expensive charge controlling agent that must be present on the surface of each toner particle tends to be included within each toner particle, so that the charge controlling agent does not function properly. If this occurs, the amount of the charge controlling agent must be increased. The result is that the toner becomes costly.

Under such circumstance, many toners which can yield images with high image quality and high durability and methods for producing such toners have been proposed.

For example, Japanese Patent Publications 51-14895 and 47-51830 propose a method of producing core particles, each of which contains a coloring pigment and a charge controlling agent, by suspension polymerization. This method, however, has the shortcomings that a dispersion stabilizer and other agents which tend to adhere to the surface of each core particle are difficult to remove from the surface of each core particle, so that the charging performance of a toner comprising the core particles is caused to deteriorate, and it is difficult to produce core particles, each of which includes the above mentioned coloring pigment and charge controlling agent, with a sharp particle distribution in a stable manner.

Japanese Patent Publications 57-494 and 56-13945 propose a method of producing core particles, each of which contains a coloring pigment and a charge controlling agent, by spray particle formation. This method, however, has the shortcomings that it is extremely difficult to control the particle size, and the produced core particles must be classified, and polymeric resins which are effective for preventing "offset phenomenon" (i.e., a phenomenon that fixed toner images, when superimposed on a plastics sheet, are transferred to the plastics sheet) cannot be used.

For obtaining particles with a uniform particle size, there are known a seed polymerization method comprising the steps of forming seed particles, and causing the seed particles to grow by polymerization, and a dispersion polymerization method of conducting polymerization by using a solvent which is a good solvent for a monomer, but which is a poor solvent for a polymer produced.

The above polymerization methods provide resin particles having small particles sizes with a sharp particle size distribution. However, it is difficult to include carbon black and other coloring agents in each resin particle by the above polymerization methods. In order to remove such shortcomings of the above polymerization methods, varieties of methods have been proposed.

For example, Japanese Laid-Open Patent Application 61-18965 discloses a method of providing a coating layer of a coloring agent or the like on the surface of each dispersion polymer particle by use of a jet mill apparatus. Japanese Laid-Open Patent Applications 63-2075, 63-23166, and 63-244057 disclose methods of embedding pigments into a thermoplastic resin with the application of mechanical strain force thereto. The thermoplastic resin, however, cannot be sufficiently dyed by the methods disclosed in the above Japanese Laid-Open Patent Applications. Furthermore, the fixing performance of the obtained toner is degraded and the offset phenomenon is caused to occur by the presence of the coloring agent on the surface of the thermoplastic resin.

Japanese Laid-Open Patent Applications 50-46333, 61-228458, 63-106667, and 1-103631 disclose methods of dyeing resin particles in a dye solution. When such methods are used, the resin particles can be sufficiently dyed deep into the inside of each resin particle, so that the dye is less present on the surface of each resin particle than in the inside of the resin particle, so that the image fixing performance and "offset phenomenon" preventing performance of the obtained toner particles are excellent. However, a dye which has a sufficiently high dyeing performance and is suitable for the above methods has not yet been discovered.

SUMMARY OF THE INVENTION

It is therefore a first object of the present invention to provide a stable toner for use in electrophotography, from which the above-mentioned shortcomings of conventional toners have been eliminated, by using a coloring agent having excellent dispersibility and high durability to heat and light.

The second object of the present invention is to provide a toner dyed with high dyeability.

The third object of the present invention is to provide an inexpensive toner having small particle sizes with a sharp particle size distribution, capable of yielding images with high image quality and high durability.

The above objects of the present invention can be achieved by a toner for developing latent electrostatic images to visible toner images, comprising as the main components a thermoplastic resin and a compound with the following formula (I) serving as a coloring agent:

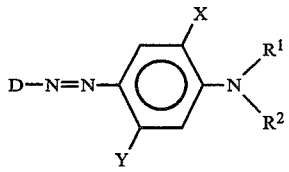

(I)

wherein D represents

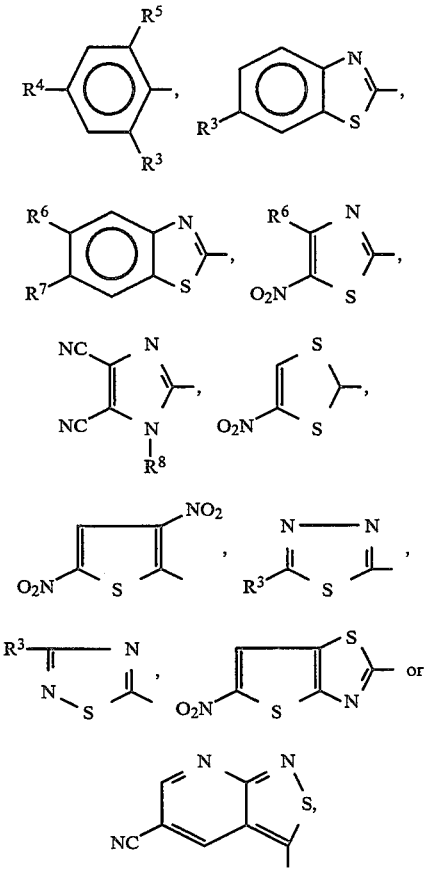

wherein X represents hydrogen, cyano group, an alkyl group having 1 to 4 carbon atoms, an alkoxyl group having 1 to 4 carbon atoms, chlorine, bromine, fluorine, or acetoxy group; Y represents hydrogen, cyano group, an alkyl group having 1 to 4 carbon atoms, an alkoxyl group having 1 to 4 carbon atoms, chlorine, bromine, fluorine, —$NHCOCH_3$, —$NHCOC_2H_5$, —$NHCOC_3H_7$, or —$NHSO_2CH_3$; $R^1$, $R^2$ and $R^8$ each represent an alkyl group having 1 to 4 carbon atoms, an alkenyl group having 1 to 4 carbon atoms, a hydroxyalkyl group, an alkoxyalkyl group, a phenoxyalkyl group, a cyanoalkyl group, a chloroalkyl group, a bromoalkyl group, an acyloxyalkyl group, an alkoxycarbonyloxyalkyl group, a benzoyloxyalkyl group, a phenoxycarbonyloxyalkyl group, an alkoxycarbonylalkyl group, a phenoxycarbonylalkyl group, a carbonylesteralkyl group, a chlorohydroxyalkyl group, an aryl group, cyclohexyl group, or benzyl group; $R^3$, $R^4$ and $R^5$ each represent hydrogen, cyano group, nitro group, chlorine, bromine, fluorine, trifluoromethyl group, an alkyl group having 1 to 8 carbon atoms or an alkoxyl group having 1 to 6 carbon atoms; and $R^6$ and $R^7$ each represent hydrogen, an alkyl group having 1 to 6 carbon atoms, cyano group, nitro group, chlorine, bromine, or fluorine.

The above objects of the present invention can also be achieved by a toner for developing latent electrostatic images to visible toner images, comprising as the main components a thermoplastic resin and a compound with the following formula (II) serving as a coloring agent:

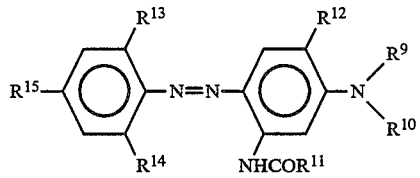

(II)

wherein $R^9$ and $R^{10}$ each represent an alkyl group having 1 to 4 carbon atoms, cyano group, hydroxyl group, an alkoxyl group having 1 to 4 carbon atoms, a lower alkoxycarbonyloxy group, a lower alkylcarbonyloxy group, a lower alkoxycarbonyl group, phenoxy group, a lower chloroalkylcarbonyloxy group, chlorine, bromine, or a lower alkyl group substituted by a lower alkylamino group or by an allyloxycarbonyl group, cyclohexyl group, benzyl group or an allyl group; $R^{11}$ represents methyl group or ethyl group; $R^{12}$ represents hydrogen, an alkyl group having 1 to 4 carbon atoms, an alkoxyl group having 1 to 4 carbon atoms, chlorine, bromine, fluorine or acetoxy group; and $R^{13}$, $R^{14}$, and $R^{15}$ each represent nitro group, chlorine, bromine, fluorine, cyano group, an alkyl group having 1 to 4 carbon atoms, or trifluoromethyl group.

Furthermore, in the present invention, pulverized particles comprising as the main component the above-mentioned thermoplastic resin may be dyed with any of the above coloring agents represented by the formula (I) or (II) to achieve the above-mentioned objects of the present invention.

Furthermore, in the present invention, it is preferable that the above-mentioned thermoplastic resin be polyester resin.

Further, in the pulverized particles comprising as the main component the thermoplastic resin, it is preferable that the pulverized particles be spherical and have a volume mean diameter (Dv) of 3 to 9 μm, and the ratio (Dv/Dp) of the volume mean diameter (Dv) to a number mean diameter (Dp) be in the range of 1.00 to 1.15.

The toner of the present invention may include a layer comprising a charge controlling agent and a lubricating agent on the surface of each toner particle.

DETAILED DESCRIPTION OF THE PREFERRED EMBODIMENTS

The compound of formula (I) serving as a coloring agent in the present invention can be produced by the diazotization of an amine component of formula (III) and subjecting the obtained diazo compound of the amine component to a coupling reaction with a coupling component of formula (IV) to produce the monoazo compound of formula (I):

$$D—NH_2 \quad \text{(III)}$$

-continued (IV)

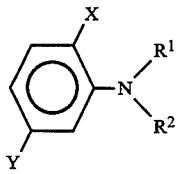

wherein D, $R^1$, $R^2$, X and Y are respectively the same as those defined in formula (I).

Specific examples of the compound of formula (I) serving as a coloring agent in the present invention are shown in the following Table 1:

TABLE 1

| Com. No. | $R^1$ | $R^2$ | X | Y | D |
|---|---|---|---|---|---|
| 1 | $CH_3$ | $CH_3$ | H | H | 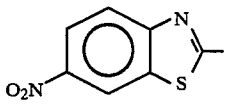 |
| 2 | $C_2H_5$ | $C_2H_5$ | $OCH_3$ | $OCH_3$ | 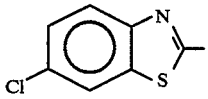 |
| 3 | $C_2H_5$ | $C_2H_5$ | Cl | Cl | 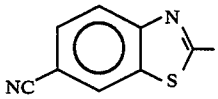 |
| 4 | $C_2H_5$ | $C_2H_5$ | H | $NHCOCH_3$ | 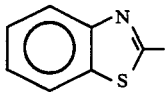 |
| 5 | $C_3H_7$ | $C_3H_7$ | $OC_2H_5$ | $NHCOCH_3$ | 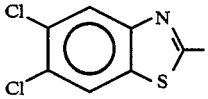 |
| 6 | $C_2H_5$ | $C_2H_4OH$ | $CH_3$ | $CH_3$ | 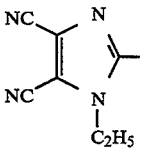 |
| 7 | $C_4H_9$ | $C_2H_4Cl$ | H | H | 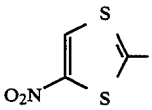 |
| 8 | $C_2H_4CN$ | $C_2H_4CN$ | $OC_2H_5$ | $NHCOC_2H_5$ | 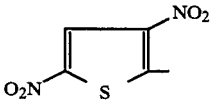 |
| 9 | $CH_2CH{=}CH_2$ | $CH_3$ | H | CN | 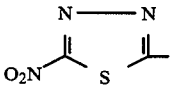 |
| 10 | $C_2H_4OCH_3$ | $C_2H_4OCH_3$ | H | $NHCOC_3H_7$ | 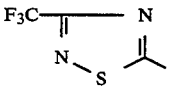 |
| 11 | $C_2H_4OCOCH_3$ | $C_2H_4OCOCH_3$ | $OC_4H_9$ | $NHCOC_3H_7$ | 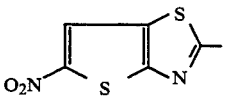 |

TABLE 1-continued

| Com. No. | $R^1$ | $R^2$ | X | Y | D |
|---|---|---|---|---|---|
| 12 | $C_2H_4COC_2H_5$ | $C_2H_5$ | $OC_4H_9$ | $NHCOC_2H_5$ | 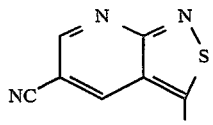 |
| 13 | $C_2H_4CN$ | 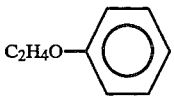 | H | $CH_3$ | 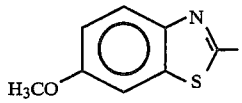 |
| 14 | $C_4H_9$ | 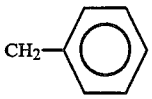 | H | Br | 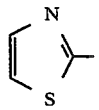 |
| 15 | $C_2H_4OCOOCH_3$ | $C_2H_4OCOOCH_3$ | H | F | 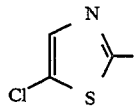 |
| 16 | $C_2H_4COOCH_3$ | $CH_3$ | H | H | 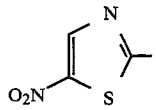 |
| 17 | n-$C_6H_{13}$ | n-$C_6H_{13}$ | H | $NHCOCH_3$ | 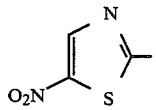 |

The compound of formula (II) serving as a coloring agent in the present invention can be produced by the diazotization of an amine component of formula (V) and subjecting the obtained diazo compound of the amine component to a coupling reaction with a coupling component of formula (VI) to produce the monoazo compound of formula (II):

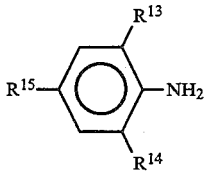

(V)

-continued

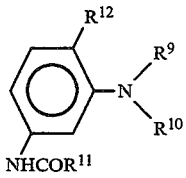

(VI)

wherein $R^9$ to $R^{15}$ are respectively the same as those defined in formula (II).

Specific examples of the compound of formula (II) serving as a coloring agent in the present invention are shown in the following Table 2:

TABLE 2

| Com. No. | $R^9$ | $R^{10}$ | $R^{11}$ | $R^{12}$ | $R^{13}$ | $R^{14}$ | $R^{15}$ |
|---|---|---|---|---|---|---|---|
| 1 | $CH_3$ | $CH_3$ | $CH_3$ | $OCH_3$ | $NO_2$ | Cl | $NO_2$ |
| 2 | $C_2H_5$ | $C_2H_5$ | $CH_3$ | H | $NO_2$ | Cl | $NO_2$ |
| 3 | $CH_3$ | $C_2H_5$ | $CH_3$ | H | $NO_2$ | Cl | $NO_2$ |
| 4 | $C_3H_7$ | $C_3H_7$ | $CH_3$ | $OCH_3$ | $NO_2$ | Br | $NO_2$ |
| 5 | $C_4H_9$ | $C_4H_9$ | $CH_3$ | $OCH_3$ | $NO_2$ | Br | $NO_2$ |
| 6 | $C_2H_4CN$ | $CH_3$ | $CH_3$ | H | Br | Br | $NO_2$ |
| 7 | $C_2H_4CN$ | $C_2H_4CN$ | $CH_3$ | H | Br | Br | $NO_2$ |
| 8 | $C_2H_4OH$ | $C_2H_5$ | $CH_3$ | $OC_2H_5$ | Br | Br | $NO_3$ |
| 9 | $C_2H_4OH$ | $C_2H_4OH$ | $CH_3$ | $OC_2H_5$ | Br | Br | $NO_2$ |
| 10 | $CH_2CH{=}CH_2$ | $CH_3$ | $CH_3$ | $OCH_3$ | Br | Br | $NO_2$ |
| 11 | $CH_2CH{=}CH_2$ | $C_2H_5$ | $C_2H_5$ | $OCH_3$ | Cl | Cl | $NO_2$ |
| 12 | $CH_2CH{=}CH_2$ | $CH_2CH{=}CH_2$ | $CH_3$ | $CH_3$ | Cl | Cl | $NO_2$ |
| 13 | $CH_2CH{=}CH_2$ | $CH_2CH{=}CH_2$ | $CH_3$ | H | F | F | F |
| 14 | $C_2H_4OCH_3$ | $C_2H_5$ | $CH_3$ | $OCH_3$ | H | H | $NO_2$ |
| 15 | $C_2H_4OCOCH_3$ | $C_2H_4OCOCH_3$ | $CH_3$ | $OCH_3$ | Br | Br | Br |
| 16 | $C_2H_4Cl$ | $C_2H_4Cl$ | $CH_3$ | $OCH_3$ | $NO_2$ | Br | $NO_2$ |
| 17 | $C_2H_4COOC_2H_5$ | $C_2H_5$ | $CH_3$ | $OCH_3$ | CN | CN | H |

TABLE 2-continued

| Com. No. | $R^9$ | $R^{10}$ | $R^{11}$ | $R^{12}$ | $R^{13}$ | $R^{14}$ | $R^{15}$ |
|---|---|---|---|---|---|---|---|
| 18 | $C_2H_4OCOCH_3$ | $C_2H_5$ | $CH_3$ | $OC_2H_5$ | CN | CN | H |
| 19 | 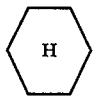 | $CH_3$ | $CH_3$ | $OC_2H_5$ | Cl | Cl | H |
| 20 | 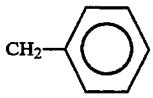 | $CH_3$ | $CH_3$ | $OC_2H_5$ | CN | Cl | Cl |
| 21 | 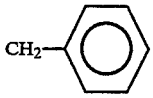 | 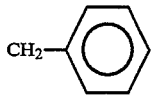 | $CH_3$ | $OCH_3$ | $CH_3$ | H | $NO_2$ |
| 22 | $C_2H_4OH$ | $C_2H_4CN$ | $CH_3$ | $OC_4H_9$ | H | H | Cl |
| 23 | $CH_3$ | $C_3H_7$ | $C_2H_5$ | $CH_3$ | Cl | H | Cl |
| 24 | $CH_3$ | 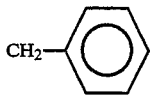 | $C_2H_5$ | Br | Cl | H | Cl |
| 25 | 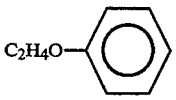 | $CH_3$ | $CH_3$ | $OCH_3$ | H | H | $CF_3$ |

Examples of the thermoplastic resin for use in the present invention include polyester resin, epoxy resin, polyurethane, homopolymers and copolymers of the following monomers: styrene, parachlorostyrene, vinyl toluene, vinyl chloride, vinyl bromide, vinyl fluoride, vinyl acetate, vinyl propionate, methyl acrylate, methyl methacrylate, ethyl acrylate, ethyl methacrylate, propyl acrylate, propyl methacrylate, n-butyl acrylate, n-butyl methacrylate, isobutyl acrylate, isobutyl methacrylate, dodecyl acrylate, dodecyl methacrylate, 2-ethylhexyl acrylate, 2-ethylhexyl methacrylate, lauryl acrylate, lauryl methacrylate, 2-hydroxyethyl acrylate, 2-hydroxyethyl methacrylate, hydroxypropyl acrylate, hydroxypropyl methacrylate, 2-chloroethyl acrylate, 2-chloroethyl methacrylate, acrylonitrile, methacrylonitrile, acrylamide, methacrylamide, acrylic acid, methacrylic acid, vinyl methyl ether, vinyl ethyl ether, vinyl isobutyl ether, vinyl methyl ketone, N-vinyl pyrrolidone, N-vinyl pyridine, ethylene, propylene, and butadiene.

Since polyester resin has a sharp melting point, and high transparency, it is suitable for use as a resin for color toners for developing latent electrostatic images into color images, by which colors are superimposed. In particular, excellent color toners for producing color images with high image quality can be produced by use of polyester resin and any of the above-mentioned dyes for use in the present invention.

For the preparation of toners, there can be used a method of kneading a mixture of any of the above-mentioned resins, or a homopolymer or copolymer of the above-mentioned monomers, a coloring agent and a charge or polarity control agent and pulverizing the kneaded mixture, and a method subjecting any of the above-mentioned monomers to suspension polymerization, together with a coloring agent and a charge control agent. However, in order to produce a toner according to the present invention, a method of dyeing resin particles obtained by a seed polymerization method of polymerizing a monomer or by a suspension polymerization method, by use of a solution of a coloring agent, is preferable.

The resin particles can be dyed with a coloring agent by a method of dispersing the resin particles and a dispersion dye in water with the application of heat thereto, or by a solvent dyeing method of dyeing the resin particles with a solution of a dye dissolved in an organic solvent. For the present invention, the solvent dyeing method is suitable when the resin particles are dyed with any of the compounds of formula (I) or (II) serving as a coloring agent.

In the solvent dyeing method, any organic solvents in general use can be used. In particular, alcohol solvents such as methanol, ethanol, n-propyl alcohol, i-propyl alcohol n-butyl alcohol, i-butyl alcohol, and t-butyl alcohol are preferable. Depending upon the solubility of the employed resin in the above alcohol solvents, an additional solvent may be added to perform the dyeing in a mixed solvent, or a surface active agent or an alcohol-soluble polymer may be added thereto.

It is preferable that the amount of the coloring agent be in the range of about 3 to 7 parts by weight to 100 parts by weight of the resin particles, although the amount of the coloring agent varies depending upon the particle size of the resin particles and the chemical structure of the coloring agent. It is preferable that the amount of the solvent in terms of weight be about 3 to 10 times the amount of the resin particles in the solvent dyeing method.

The compounds of formula (I) and (II) serving as coloring agents for use in the present invention can be used individually, but may be used in combination with any of the following dyes in order to adjust the color tone to be obtained: C.I. Solvent Yellow (6, 9, 17, 31, 35, 100, 102, 105); C.I. Solvent Orange (2, 7, 13, 14, 66); C.I. Solvent Red (5, 16, 17, 18, 19, 22, 23, 143, 145, 146, 149, 150, 151, 157, 158); C.I. Solvent Violet (31, 32, 33, 37); C.I. Solvent Blue (22, 63, 78, 83 to 86, 91, 94, 95, 104); C.I. Solvent Green (24, 25); and C.I. Solvent Brown (3, 9).

It is preferable that the above dyes be added in an amount of 10 wt. % or more of the total weight of the added dye and one of the compound (I) or (II).

A coating layer comprising a charge controlling agent and/or a lubricating agent may be provided on the thus dyed surface of each of the resin particles.

Specific examples of the charge controlling agent for use in the present invention are as follows: nigrosine; azine dyes containing an alkyne group having 2 to 16 carbon atoms as disclosed in Japanese Patent Publication 42-1627; basic dyes such as C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000); lake pigments of the above basic dyes in which phosphorus wolframate, phosphorus molybdate, tannic acid, lauric acid, gallic acid, ferricyanide or ferrocyanide is employed as a lake-formation agent; C.I. Solvent Black 3 (C.I. 26150); Hansa Yellow G (C.I. 11680); C.I. Mordlant Black 11, C.I. Pigment Black 1; benzoylmethylhexadecyl-ammonium chloride; decyl-trimethylaluminum chloride; dialkyltin borate compounds such as dibutyl and dioctyl; guanidine derivatives; polyamine resins such as a vinyl polymer containing an amino group and a condensation-type polymer containing an amino group; metal complexes of monoazo dye disclosed in Japanese Patent Publications 41-20153, 43-27596, 44-6397, and 45-26478; metal complexes of Zn, Al, Co, Cr, and Fe with salicylic acid, dialkylsalicylic acid, naphthoic acid, or dicarboxylic acid disclosed in Japanese Patent Publications 55-42752, 54-415080, 58-7384, and 59-7385; and a sulphonated copper phthalocyanine pigment.

Specific examples of the lubricating material include low-molecular-weight polyolefins such as a low-molecular-weight polyethylene, a low-molecular-weight polypropylene, and oxidized polyethylene; natural waxes such as bees wax, carnauba wax, and nontan wax; metal salts of higher fats and fatty acids such as stearic acid, palmitic acid, and myristic acid; and amides of higher fatty acids. These can be used alone or in combination. Of these, lower-molecular-weight polyolefins such as polypropylene are preferable for use in the present invention.

The above-mentioned charge controlling agents and lubricating materials can be coated on the toner particles by conventional methods. For instance, dyed particles, a charge controlling agent and a lubricating material are mixed in a dry system or in a wet system, so that the charge controlling agent and the lubricating material are deposited on the surface of each dyed particle. Mechanical energy is applied to this mixture, whereby a resin-coated coloring agent is driven into the surfaces of the resin particles, and the charge controlling agent and the lubricating agent are coated on the surfaces of the resin particles. The mechanical energy can be applied to the mixture, for instance, by the application of abrasion force, by the application of impact force, using blades rotated at high speed, or by causing the particles to collide with other particles or with a collision plate in a jet stream of the particles. Specific examples of a driving apparatus for performing the above operations include Mechano Fusion System (made by Hosokawa Micron Corporation), Impact Mill (made by Nippon Pnewmatic Mfg. Co., Ltd.) with the milling air pressure thereof reduced in comparison with that in the case of normal milling, Turbo Mill (made by Turbo Kogyosha Co., Ltd.), Hybridizer and Cosmomizer (made by Nara Machinery Co., Ltd.) and automatic mortar.

Examples of the production of resins employed in the present invention will now be explained.

Production Example 1

15 parts by weight of polyacrylic acid were dissolved in 150 parts by weight of methanol in a reactor. The atmosphere in the reactor was replaced by nitrogen gas, and a solution of 0.82 parts by weight of azobisisobutyronitrile dissolved in 52 parts by weight of styrene was added to the methanol solution of polyacrylic acid. The mixture was stirred at 60° C. for 8 hours to carry out dispersion polymerization and was then allowed to stand at room temperature for 24 hours. The supernatant was removed from the reaction mixture by decantation. 100 parts by weight of methanol were added to the remaining reaction mixture. This mixture was stirred for 30 minutes. A product was separated from the reaction mixture by filtration and dried, whereby 49 parts by weight of a white powder were obtained.

The volume mean diameter (Dv) of the powder was 7.36 and the ratio of Dv/Dp (number mean diameter) was 1.09. The particle size distribution of the powder was sharp.

Production Examples 2 to 9

The procedure for Production Example 1 was repeated except that the styrene employed in Production Example 1 was replaced by the monomers in the following Table 3, respectively, whereby the resin particles with Dv and Dv/Dp as shown in Table 3 were obtained.

TABLE 3

| Production Example No. | Monomer Composition (Weight by Ratio) | Dv | Dv/Dp |
|---|---|---|---|
| 2 | St/n-BMA = 6/4 | 6.83 | 1.11 |
| 3 | St/2-EHMA = 8/2 | 6.25 | 1.12 |
| 4 | St/nBA = 7/3 | 6.44 | 1.08 |
| 5 | St/MA = 6/4 | 5.56 | 1.07 |
| 6 | St/MA = 5/5 | 4.78 | 1.08 |
| 7 | St/nBMA/2EHMA = 7/2/1 | 7.26 | 1.09 |
| 8 | St/nBMA/AA = 6/3.5/0.5 | 6.55 | 1.10 |
| 9 | St/nBMA/4VPy = 6/3.5/0.5 | 6.62 | 1.13 |

In the above Table 3, St denotes styrene; n-BMA, n-butyl methacrylate; 2-EHMA, 2-ethylhexyl methacrylate; nBA, n-butyl acrylate; MA, methyl acrylate; AA, acrylic acid; and 4VPy, 4-vinylpyridine.

Comparative Production Example 1

5 parts by weight of polyacrylic acid were dissolved in 150 parts by weight of methanol in a reactor. The atmosphere in the reactor was replaced by nitrogen gas, and a solution of 0.82 parts by weight of azobisisobutyronitrile dissolved in 52 parts by weight of styrene was added to the methanol solution of polyacrylic acid. The mixture was stirred at 60° C. for 8 hours to carry out dispersion polymerization and was then allowed to stand at room temperature for 24 hours. The supernatant was removed from the reaction mixture by decantation. 100 parts by weight of methanol were added to the remaining reaction mixture. This mixture was stirred for 30 minutes. A product was separated from the reaction mixture by filtration and dried, whereby 49 parts by weight of a white powder were obtained.

The volume mean diameter (Dv) of the powder was 10.08 μm and the ratio of Dv/Dp (number mean diameter) was 1.35.

Production Example 10

[Preparation of Polyester Resin]

1000 g of polyoxypropylene (2,2)-2,2-bis(4-hydroxyphenyl)propane, 273.1 g of terephthalic acid, 286 g of n-dodecylsuccinic acid, and 0.1 g of hydroquinone were placed in a four-necked flask equipped with a thermometer, a condenser, a stirrer, and a nitrogen-gas-introducing pipe, and were allowed to react at 230° C. in a stream of nitrogen gas. When water was not formed any more from the reaction mixture, the reaction was terminated, whereby a light yellow polyester resin was obtained.

The thus obtained polyester resin was pulverized and then classified, whereby polyester resin particles with a volume mean diameter (Dv) of 3 to 9 μm, and a Dv/Dp ratio of 1.13 were obtained.

EXAMPLE 1

A mixture of the following components was heated and kneaded by heat application rollers:

| | Parts by Weight |
|---|---|
| Polyester resin prepared in Production Example 1 | 100 |
| Compound No. 1 in Table 1 | 3 |
| Zinc 3,5-di-t-butyl salicylate | 1 |

The above kneaded mixture was pulverized so that a toner with a volume mean diameter of 8 μm was obtained.

3 parts by weight of the toner and 100 parts by weight of an iron powder carrier were mixed to prepare a developer. The thus prepared developer was placed in a magnetic brush development unit of a commercially available copying machine (made by Ricoh Company, Ltd. under the trademark "FT4060").

Latent electrostatic images were formed on a selenium photoconductor of the above-mentioned copying machine by a conventional electrophotographic process and were then developed by the above prepared developer to visible toner images. The thus obtained toner images were transferred to a sheet of paper and to a sheet of Mylar and fixed theretro, whereby red images were obtained.

The toner image transferred to the sheet of paper was exposed to light by use of a fademeter for 5 hours, but neither discoloration nor color fading was observed.

The hase degree of the toner image transferred to the Mylar sheet measured 25, with excellent transparency.

EXAMPLE 2

0.5 parts by weight of Compound No. 3 in Table 1 were dissolved in 100 parts by weight of methanol with the application of heat thereto. 10 parts by weight of the resin particles prepared in Production Example 1 were added to the above mixture. The mixture was refluxed with the application of heat, with stirring, for 1 hour, whereby the resin particles were dyed. The mixture was then cooled to room temperature, and the dye resin particles were separated by suction filtration, whereby red dyed resin particles were obtained.

10 parts by weight of the red dyed resin particles and 0.1 parts by weight of zinc 3,5-di-t-butyl salicylate were placed in a blender and the mixture was stirred for 5 minutes. The mixture was then pulverized in a mill named "Hyridization NHS-O" (made by Nara Machinery Co., Ltd.) at 10,000 rpm, whereby a red toner was obtained.

3 parts by weight of the thus obtained red toner and 100 parts by weight of an iron powder carrier were mixed to prepare a developer. The thus prepared developer was placed in a magnetic brush development unit of a commercially available copying machine (made by Ricoh Company, Ltd. under the trademark "FT4060").

A latent electrostatic images was formed on a selenium photoconductor of the above-mentioned copying machine by a conventional electrophotographic process and was then developed by the above prepared developer to a visible toner images. The thus obtained toner image was transferred to a sheet of paper and fixed thereto, whereby a clear red toner image was obtained on the paper.

In order to investigate the sublimation of the thus obtained toner image, a polyester film was placed in close contact with the toner image formed on the paper, and then placed in a thermostatic chamber at 100° C. for 5 hours, and the sublimation of the dye from the toner image onto the polyester film was visually inspected, but no sublimation of the dye was observed.

Apart from the above, the toner image formed on the paper was exposed to light by a fademeter for 5 hours, but neither discoloration nor color fading was observed.

The toner image formed on the above-mentioned photoconductor was also transferred to a Mylar sheet in the same manner as in Example 1 and the hase degree of the toner image transferred to the Mylar sheet measured 18.

EXAMPLE 3

10 parts by weight of the resin particles prepared in Production Example 2 were dispersed in 35 parts by weight of methanol, and the temperature of the mixture was raised to 50° C. With the temperature of the mixture maintained at 50° C., 0.5 parts by weight of Compound No. 10 in Table 1 were gradually added to the mixture, and the mixture was stirred for 8 hours. The mixture was then cooled to room temperature, and filtered, whereby a blue dyed powder was obtained.

10 parts by weight of the dyed powder were dispersed in 100 ml of ion-exchanged water. To this dispersion, one part by weight of a carnauba wax emulsion (with 20% solid component) was gradually added. The mixture was stirred at room temperature for 1 hour, and the dyed powder was filtered off, and dried, whereby the wax component was deposited on the surface of each particle of the dyed powder. The wax-deposited dyed powder and 0.1 parts by weight of zinc 3,5-di-tert-butyl salicylate were stirred in a blender for 5 minutes, and the mixture was then pulverized in a commercially available mill (Trademark "Hyridization NHS-O" made by Nara Machinery Co., Ltd.) at 10,000 rpm for 5 minutes, whereby a blue toner was obtained.

3 parts by weight of the thus obtained blue toner and 100 parts by weight of an iron powder carrier were mixed to prepare a developer.

By use of this developer, latent electrostatic images formed on a selenium photoconductor were developed to visible toner images. The thus obtained toner images were transferred to a sheet of paper and fixed thereto, whereby clear blue toner images were obtained on the paper in the same manner as in Example 1. This copying test was repeated by making 10,000 copies, using the above developer. Clear blue images with excellent line images and halftone images were obtained in a stable manner during this copy making test.

EXAMPLES 4 to 8

The procedure for Example 3 was repeated except that the resin and Compound No. 10 serving as the coloring agent employed in Example 3 were respectively replaced by the resins and the coloring agents given in Table 4, whereby dyed powders were obtained. By use of these dyed powders, dyed toners were prepared in the same manner as in the procedure for Example 2.

The dyeability, resistance to light, and sublimation properties of each of these toners were investigated. The results are shown in Table 4.

Comparative Examples 1 and 2

The procedure for Example 3 was repeated except that Compound No. 10 serving as the coloring agent employed in Example 3 was replaced by Solvent Yellow 14, and Solvent Blue 25, which are oil-soluble dyes, whereby comparative toners were prepared.

The dyeability, resistance to light, and sublimation properties of each of these comparative toners were investigated. The results are shown in Table 4.

TABLE 4

| Ex. No. | Resin | Coloring Agent | Dyeability | Resistance to Light | Sublimation Properties | Transparency |
|---|---|---|---|---|---|---|
| Ex. 4 | Production Ex. 3 | No. 8 | 3.85 g | O | A | 23 |
| Ex. 5 | Production Ex. 4 | No. 10 | 3.93 g | O | A | 26 |
| Ex. 6 | Production Ex. 5 | No. 12 | 4.01 g | O | A | 28 |
| Ex. 7 | Production Ex. 7 | No. 13 | 3.95 g | O | A | 25 |
| Ex. 8 | Production Ex. 8 | No. 17 | 4.16 g | O | A | 21 |
| Com. Ex. 1 | Production Ex. 3 | SOL. Y-14 | 3.83 g | X | B | 22 |
| Com. Ex. 2 | Production Ex. 3 | SOL. B-25 | 0.00 g | — | — | — |

The evaluations with respect to the dyeability, light resistance, sublimation properties, and transparency of each toner in Table 4 were conducted as follows:

Dyeability: 0.1 g of each dyed toner was placed in 50 ml of acetone, and the dye was dissolved in the acetone. The dyeability was determined by measuring the amount of the dissolved dye from the absorbance of the absorption spectrum of the dye solution and a calibration curve of the amount of the dye dissolved in acetone.

Resistance to Light: Each toner image was exposed to the light from a commercially available xenon tester (made by Shimadzu Corporation) for 10 hours, and the changes in the color of the toner image were visually investigated.

o: Substantially no changes in the color after the exposure x: Changes in the color observed after the exposure Sublimation Properties: A polyester film was superimposed on each toner in close contact therewith and maintained at 70° C. for 5 hours in a thermostatic chamber, and the dye deposited on the polyester film by sublimation was visually inspected.

A: No sublimation observed

B: Sublimation observed

Transparency: Determined by the haze degree of each toner image transferred to a Mylar sheet

EXAMPLE 9

10 parts by weight of the resin particles prepared in Production Example 6 were dispersed in 35 parts by weight of methanol, and the temperature of the mixture was raised to 50° C. With the temperature of the mixture maintained at 50° C., 0.4 parts by weight of Compound No. 16 in Table 1, 0.17 parts by weight of Yellow #818 (made by Yamamoto Chemicals, Inc.) and 0.1 parts by weight of PS Red G (Mitsui Toatsu Dyes, Ltd.) were gradually added to the mixture, and the mixture was stirred for 8 hours. The mixture was then cooled to room temperature, and filtered, whereby a black dyed powder was obtained.

10 parts by weight of the dyed powder were dispersed in 100 ml of ion-exchanged water. To this dispersion, one part by weight of a carnauba wax emulsion (with 20% solid component) was gradually added. The mixture was stirred at room temperature for 1 hour, and the dyed powder was filtered off, and dried, whereby the wax component was deposited on the surface of each particle of the dyed powder.

The wax-deposited dyed powder and 0.1 parts by weight of a metal-containing azo dye (Trademark "S-34" made by Orient Chemical Industries, Ltd.) were mixed and stirred in a blender for 5 minutes, and the mixture was then pulverized in a commercially available mill (Trademark "Hyridization NHS-O" made by Nara Machinery Co., Ltd.) at 10,000 rpm for 5 minutes, whereby a black toner was obtained.

3 parts by weight of the thus obtained black toner and 100 parts by weight of an iron powder carrier were mixed to prepare a developer.

By use of this developer, latent electrostatic images formed on a selenium photoconductor were developed to visible toner images in the same manner as in Example 1. The thus obtained toner images were transferred to a sheet of paper and fixed thereto, whereby clear black toner images were obtained on the paper in the same manner as in Example 1. This copying test was repeated by making 10,000 copies, using the above developer. Clear black images with excellent line images and halftone images were obtained in a stable manner during this copy making test.

EXAMPLE 10

A mixture of the following components was heated and kneaded by heat application rollers:

| | Parts by Weight |
|---|---|
| Polyester resin prepared in Production Example 10 | 100 |
| Compound No. 1 in Table 2 | 5 |
| Zinc 3,5-di-t-butyl salicylate | 1 |

The above kneaded mixture was pulverized so that a toner with a volume mean diameter of 8 μm was obtained.

3 parts by weight of the toner and 100 parts by weight of an iron powder carrier were mixed to prepare a developer.

By use of the thus prepared developer, copies were made in the same manner as in Example 1, whereby clear blue copied images were obtained.

EXAMPLE 11

0.5 parts by weight of Compound No. 4 in Table 2 were dissolved in 100 parts by weight of methanol with the application of heat thereto. 10 parts by weight of the resin particles prepared in Production Example 1 were added to the above mixture. The mixture was refluxed with the application of heat, with stirring, for 1 hour, whereby the resin particles were dyed. The mixture was then cooled to room temperature, and the dye resin particles were separated by suction filtration, whereby blue dyed resin particles were obtained.

10 parts by weight of the blue dyed resin particles and 0.1 parts by weight of zinc 3,5-di-t-butyl salicylate were placed in a blender and the mixture was stirred for 5 minutes. The mixture was then pulverized in a commercially available mill (Trademark "Hyridization NHS-O" made by Nara Machinery Co., Ltd.) at 10,000 rpm for 5 minutes, whereby a blue toner was obtained.

3 parts by weight of the thus obtained blue toner and 100 parts by weight of an iron powder carrier were mixed to prepare a developer.

By use of this developer, latent electrostatic images formed on a selenium photoconductor were developed to visible toner images in the same manner as in Example 1. The thus obtained toner images were transferred to a sheet of paper and fixed thereto, whereby clear blue toner images were obtained on the paper in the same manner as in Example 1. This copying test was repeated by making 10,000 copies, using the above developer. Clear blue images with excellent line images and halftone images were obtained in a stable manner during this copy making test.

EXAMPLE 12

10 parts by weight of the resin particles prepared in Production Example 2 were dispersed in 35 parts by weight of methanol, and the temperature of the mixture was raised to 50° C. With the temperature of the mixture maintained at 50° C., 0.5 parts by weight of Compound No. 10 in Table 2 were gradually added to the mixture, and the mixture was stirred for 8 hours. The mixture was then cooled to room temperature, and filtered, whereby a blue dyed powder was obtained.

10 parts by weight of the dyed powder were dispersed in 100 ml of ion-exchanged water. To this dispersion, one part by weight of a carnauba wax emulsion (with 20% solid component) was gradually added. The mixture was stirred at room temperature for 1 hour, and the dyed powder was filtered off, and dried, whereby the wax component was deposited on the surface of each particle of the dyed powder.

The wax-deposited dyed powder and 0.1 parts by weight of zinc 3,5-di-tert-butyl salicylate were mixed and stirred in a blender for 5 minutes, and the mixture was then pulverized in a commercially available mill (Trademark "Hyridization NHS-O" made by Nara Machinery Co., Ltd.) at 10,000 rpm for 5 minutes, whereby a blue toner was obtained.

3 parts by weight of the thus obtained blue toner and 100 parts by weight of an iron powder carrier were mixed to prepare a developer.

By use of this developer, latent electrostatic images formed on a selenium photoconductor were developed to visible toner images in the same manner as in Example 1. The thus obtained toner images were transferred to a sheet of paper and fixed thereto, whereby clear blue toner images were obtained on the paper in the same manner as in Example 1. This copying test was repeated by making 10,000 copies, using the above developer. Clear blue images with excellent. line images and halftone images were obtained in a stable manner during this copy making test.

EXAMPLES 13 to 17

The procedure for Example 12 was repeated except that the resin and Compound No. 10 serving as the coloring agent in Table 2 employed in Example 12 were respectively replaced by the resins and the coloring agents given in Table 1, whereby blue dyed powders were obtained. By use of these dyed powders, dyed toners were prepared in the same manner as in Example 12.

3 parts by weight of each of the thus obtained blue toners and 100 parts by weight of an iron powder carrier were mixed to prepare developers.

By use of each of these developers, latent electrostatic images formed on a selenium photoconductor were developed to visible toner images in the same manner as in Example 1. The thus obtained toner images were transferred to a sheet of paper and fixed thereto, whereby clear blue toner images were obtained on the paper in the same manner as in Example 1. This copying test was repeated by making 10,000 copies, using each of the above developers. Clear blue images with excellent line images and halftone images were obtained in a stable manner during this copy making test.

Comparative Examples 3 and 4

The procedure for Example 12 was repeated except that Compound No. 10 serving as the coloring agent in Table 2 employed in Example 12 was replaced by Solvent Yellow 14, and Solvent Blue 25, respectively, which are oil-soluble dyes, whereby it was tried to obtain dyed powders. The resin was dyed with Solvent Yellow 14 in Comparative Example 3, but was not dyed with Solvent Blue 25 in Comparative Example 4.

10 parts by weight of the dyed powder obtained in Comparative Example 3 were dispersed in 100 ml of ion-exchanged water. To this dispersion, one part by weight of a carnauba wax emulsion (with 20% solid component) was gradually added. The mixture was stirred at room temperature for 1 hour, and the dyed powder was filtered off, and dried, whereby the wax component was deposited on the surface of each particle of the dyed powder.

The wax-deposited dyed powder and 0.1 parts by weight of zinc 3,5-di-tert-butyl salicylate were mixed and stirred in a blender for 5 minutes, and the mixture was then pulverized in a commercially available mill (Trademark "Hyridization NHS-O" made by Nara Machinery Co., Ltd.) at 10,000 rpm for 5 minutes, whereby a yellow toner was obtained.

3 parts by weight of the thus obtained yellow toner and 100 parts by weight of an iron powder carrier were mixed to prepare a developer.

By use of this developer, latent electrostatic images formed on a selenium photoconductor were developed to visible toner images in the same manner as in Example 1. The thus obtained toner images were transferred to a sheet of paper and fixed thereto, whereby clear yellow toner images were obtained on the paper in the same manner as in Example 1. However, the resistance to light of the obtained toner images was extremely poor as shown in Table 5.

Comparative Example 5

The procedure for Example 11 was repeated except that the resin prepared in Production Example 11, employed in Example 11, was replaced by the resin prepared in Comparative Production Example 1, having a broader particle size distribution than that of the resin employed in Example 11, whereby a blue toner was prepared.

3 parts by weight of the thus prepared blue toner and 100 parts by weight of an iron powder carrier were mixed to prepare a comparative developer.

By use of this comparative developer, latent electrostatic images formed on a selenium photoconductor were developed to visible toner images in the same manner as in Example 1. The thus obtained toner images were transferred to a sheet of paper and fixed thereto, whereby clear blue toner images were obtained on the paper in the same manner as in Example 1. This copy making was repeated, and when the number of copies amounted to about 5,000, the images obtained became unsharp. The Dv/Dp of the toner by which the toner particle distribution can be measured changed to 1.5 while in use.

Table 5 shows the properties of the toners prepared in Examples 10 to 17 and Comparative Examples 3 to 5, and the characteristics of the toner images obtained by the respective toners prepared in the Examples. The toner images were evaluated in accordance with the same evaluation standards as in Table 4.

TABLE 5

| Ex. No. | Resin | Dv/Dp | Coloring Agent | Dyeability (g) | Resistance to Light | Sublimation Properties |
|---|---|---|---|---|---|---|
| Ex. 10 | Polyester | 1.13 | No. 1 in Table 2 | / | O | A |
| Ex. 11 | Preparation Ex. 1 | 1.09 | No. 4 in Table 2 | 4.08 | O | A |
| Ex. 12 | Preparation Ex. 2 | 1.11 | No. 10 in Table 2 | 4.03 | O | A |
| Ex. 13 | Preparation Ex. 3 | 1.12 | No. 7 in Table 2 | 3.75 | O | A |
| Ex. 14 | Preparation Ex. 4 | 1.08 | No. 12 in Table 2 | 3.82 | O | A |
| Ex. 15 | Preparation Ex. 5 | 1.07 | No. 15 in Table 2 | 4.11 | O | A |
| Ex. 16 | Preparation Ex. 7 | 1.08 | No. 18 in Table 2 | 3.79 | O | A |
| Ex. 17 | Preparation Ex. 8 | 1.09 | No. 24 in Table 2 | 3.96 | O | A |
| Comp. Ex. 3 | Preparation Ex. 3 | 1.10 | sol. Y-2 | 3.83 | X | B |
| Comp. Ex. 4 | Preparation Ex. 3 | 1.13 | sol. B-25 | 0.00 | — | — |
| Comp. Ex. 5 | Comparative Preparation Ex. 1 | 1.35 | No. 4 in Table 2 | 3.71 | O | A |

EXAMPLE 18

10 parts by weight of the resin particles prepared in Production Example 6 were dispersed in 35 parts by weight of methanol, and the temperature of the mixture was raised to 50° C. With the temperature of the mixture maintained at 50° C., 0.4 parts by weight of Compound No. 16 in Table 2, 0.17 parts by weight of Yellow #818 (made by Yamamoto Chemicals, Inc.) and 0.1 parts by weight of PS Red G (Mitsui Toatsu Dyes, Ltd.) were gradually added to the mixture, and the mixture was stirred for 8 hours. The mixture was then cooled to room temperature, and filtered, whereby a black dyed powder was obtained.

10 parts by weight of the dyed powder were dispersed in 100 ml of ion-exchanged water. To this dispersion, one part by weight of a carnauba wax emulsion (with 20% solid component) was gradually added. The mixture was stirred at room temperature for 1 hour, and the dyed powder was filtered off, and dried, whereby the wax component was deposited on the surface of each particle of the dyed powder.

The wax-deposited dyed powder and 0.1 parts by weight of a metal-containing azo dye (Trademark "S-34" made by Orient Chemical Industries, Ltd.) were mixed and stirred in a blender for 5 minutes, and the mixture was then pulverized in a commercially available mill (Trademark "Hyridization NHS-O" made by Nara Machinery Co., Ltd.) at 10,000 rpm for 5 minutes, whereby a black toner was obtained.

3 parts by weight of the thus obtained black toner and 100 parts by weight of an iron powder carrier were mixed to prepare a developer.

By use of this developer, latent electrostatic images formed on a selenium photoconductor were developed to visible toner images in the same manner as in Example 1. The thus obtained toner images were transferred to a sheet of paper and fixed thereto, whereby clear black toner images were obtained on the paper in the same manner as in Example 1.

This copying test was repeated by making 10,000 copies, using the above developer. Clear black images with excellent line images and halftone images were obtained in a stable manner during this copy making test.

The toner according to the present invention comprises as the main components a thermoplastic resin and a particular coloring agent selected from the group consisting of the previously mentioned compound of formula (I) and compound of formula (II). The thermoplastic resin may be dyed with the above particular dye when preparing the toner. Furthermore, instead of the thermoplastic resin, there can be employed pulverized particles comprising as the main component the above thermoplastic resin in the form of substantially spherical particles with a volume mean diameter (Dv) in the range of 3 to 9 μm, and a Dv/Dp ratio of 1.05 to 1.15. Because of these features in the composition, the toner according to the present invention has a sharp toner particle distribution, and is capable of providing toner images with high image quality and excellent durability to heat and light.

What is claimed is:

1. A toner for developing latent electrostatic images to visible toner images, comprising toner particles which comprise a thermoplastic resin and a compound with formula (I) serving as a coloring agent:

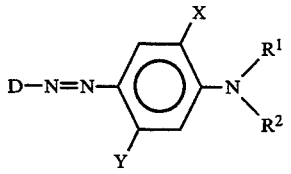

(I)

wherein D represents

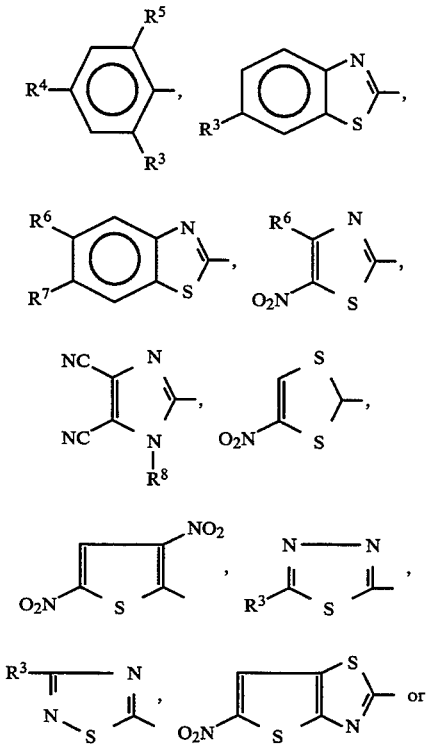

-continued

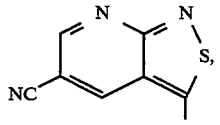

wherein X represents hydrogen, cyano group, an alkyl group having 1 to 4 carbon atoms, an alkoxyl group having 1 to 4 carbon atoms, chlorine, bromine, fluorine, or acetoxy group; Y represents hydrogen, cyano group, an alkyl group having 1 to 4 carbon atoms, an alkoxyl group having 1 to 4 carbon atoms, chlorine, bromine, fluorine, or a group represented by $—NHCOCH_3$, $—NHCOC_2H_5$, $—NHCOC_3H_7$, or $—NHSO_2CH_3$; $R^1$, $R^2$ and $R^8$ each represent an alkyl group having 1 to 4 carbon atoms, an alkenyl group having 1 to 4 carbon atoms, a hydroxyalkyl group, an alkoxyalkyl group, a phenoxyalkyl group, a cyanoalkyl group, a chloroalkyl group, a bromoalkyl group, an acyloxyalkyl group, an alkoxycarbonyloxyalkyl group, benzoyloxyalkyl group, a phenoxycarbonyloxyalkyl group, an alkoxycarbonylalkyl group, a phenoxycarbonylalkyl group, a carbonylesteralkyl group, a chlorohydroxyalkyl group, an aryl group, cyclohexyl group, or benzyl group; and $R^3$, $R^4$, and $R^5$ each represent hydrogen, cyano group, nitro group, chlorine, bromine, fluorine, trifluoromethyl group, an alkyl group having 1 to 8 carbon atoms or an alkoxyl group having 1 to 6 carbon atoms; and $R^6$ and $R^7$ each represent hydrogen, an alkyl group having 1 to 6 carbon atoms, cyano group, nitro group, chlorine, bromine, or fluorine.

2. The toner as claimed in claim 1, wherein said thermoplastic resin is polyester resin.

3. The toner as claimed in claim 1, further comprising a layer comprising a charge controlling agent and a lubricating agent, provided on the surface of each of said toner particles.

4. A toner for developing latent electrostatic images to visible toner images, comprising toner particles which comprise a thermoplastic resin and a compound with the following formula (II) serving as a coloring agent:

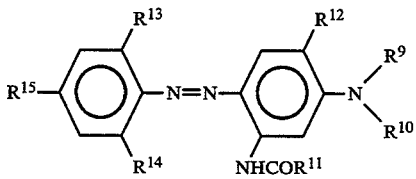

(II)

wherein $R^9$ and $R^{10}$ each represent an alkyl group having 1 to 4 carbon atoms, cyano group, hydroxyl group, an alkoxyl group having 1 to 4 carbon atoms, a lower alkoxycarbonyloxy group, a lower alkylcarbonyloxy group, a lower alkoxycarbonyl group, phenoxy group, a lower chloroalkylcarbonyloxy group, chlorine, bromine, or a lower alkyl group substituted by a lower alkylamino group or an allyloxycarbonyl group, cyclohexyl group, benzyl group or an allyl group; $R^{11}$ represents methyl group or ethyl group; $R^{12}$ represents hydrogen, an alkyl group having 1 to 4 carbon atoms, an alkoxyl group having 1 to 4 carbon atoms, chlorine, bromine, fluorine or acetoxy group; and $R^{13}$, $R^{14}$, and $R^{15}$ each represent nitro group, chlorine, bromine, fluorine, cyano group, an alkyl group having 1 to 4 carbon atoms or trifluoromethyl group.

5. The toner as claimed in claim 4, wherein said thermoplastic resin is polyester resin.

6. The toner as claimed in claim 4, further comprising a layer comprising a charge controlling agent and a lubricating agent, provided on the surface of each of said toner particles.

7. A toner for developing latent electrostatic images to visible toner images, comprising pulverized particles which comprise a thermoplastic resin, said pulverized particles being dyed with a compound with formula (I) serving as a coloring agent:

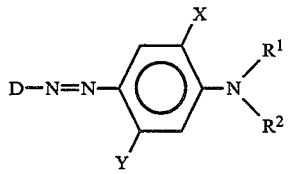

(I)

wherein D represents

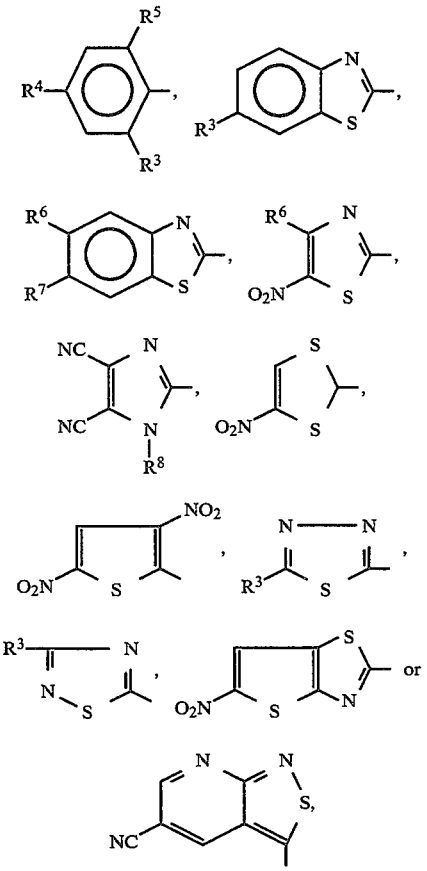

wherein X represents hydrogen, cyano group, an alkyl group having 1 to 4 carbon atoms, an alkoxyl group having 1 to 4 carbon atoms, chlorine, bromine, fluorine, or acetoxy group; Y represents hydrogen, cyano group, an alkyl group having 1 to 4 carbon atoms, an alkoxyl group having 1 to 4 carbon atoms, chlorine, bromine, fluorine, or a group represented by $-NHCOCH_3$, $-NHCOC_2H_5$, $-NHCOC_3H_7$, or $-NHSO_2CH_3$; $R^1$, $R^2$ and $R^8$ each represent an alkyl group having 1 to 4 carbon atoms, an alkenyl group having 1 to 4 carbon atoms, a hydroxyalkyl group, an alkoxyalkyl group, a phenoxyalkyl group, a cyanoalkyl group, a chloroalkyl group, a bromoalkyl group, an acyloxyalkyl group, an alkoxycarbonyloxyalkyl group, benzoyloxyalkyl group, a phenoxycarbonyloxyalkyl group, an alkoxycarbonylalkyl group, a phenoxycarbonylalkyl group, a carbonylesteralkyl group, a chlorohydroxyalkyl group, an aryl group, cyclohexyl group or benzyl group; $R^3$, $R^4$, and $R^5$ each represent hydrogen, cyano group, nitro group, chlorine, bromine, fluorine, trifluoromethyl group, an alkyl group having 1 to 8 carbon atoms or an alkoxyl group having 1 to 6 carbon atoms; and $R^6$ and $R^7$ each represent hydrogen, an alkyl group having 1 to 6 carbon atoms, cyano group, nitro group, chlorine, bromine, or fluorine.

8. The toner as claimed in claim 7, wherein said pulverized particles are spherical and have a volume mean diameter (Dv) of 3 to 9 μm, and the ratio (Dv/Dp) of the volume mean diameter (Dv) to a number mean diameter (Dp) be in the range of 1.00 to 1.15.

9. The toner as claimed in claim 7, wherein said thermoplastic resin is polyester resin.

10. The toner as claimed in claim 7, further comprising a layer comprising a charge controlling agent and a lubricating agent, provided on the surface of each of said toner particles.

11. A toner for developing latent electrostatic images to visible toner images, comprising pulverized particles which comprise a thermoplastic resin, said pulverized particles being dyed with a compound with formula (II) serving as a coloring agent:

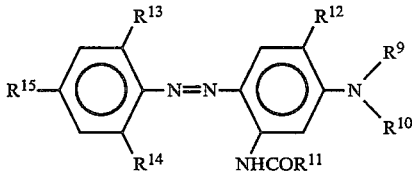

(II)

wherein $R^9$ and $R^{10}$ each represent an alkyl group having 1 to 4 carbon atoms, cyano group, hydroxyl group, an alkoxyl group having 1 to 4 carbon atoms, a lower alkoxycarbonyloxy group, a lower alkylcarbonyloxy group, a lower alkoxycarbonyl group, phenoxy group, a lower chloroalkylcarbonyloxy group, chlorine, bromine, or a lower alkyl group substituted by a lower alkylamino group or an allyloxycarbonyl group, cyclohexyl group, benzyl group or an allyl group ; $R^{11}$ represents methyl group or ethyl group; $R^{12}$ represents hydrogen, an alkyl group having 1 to 4 carbon atoms, an alkoxyl group having 1 to 4 carbon atoms, chlorine, bromine, fluorine or acetoxy group; and $R^{13}$, $R^{14}$, and $R^{15}$ each represent nitro group, chlorine, bromine, fluorine, cyano group, an alkyl group having 1 to 4 carbon atoms or trifluoromethyl group.

12. The toner as claimed in claim 11, wherein said pulverized particles are spherical and have a volume mean diameter (Dv) of 3 to 9 μm, and the ratio (Dv/Dp) of the volume mean diameter (Dv) to a number mean diameter (Dp) be in the range of 1.00 to 1.15.

13. The toner as claimed in claim 11, wherein said thermoplastic resin is polyester resin.

14. The toner as claimed in claim 11, further comprising a layer comprising a charge controlling agent and a lubricating agent, provided on the surface of each of said toner particles.

15. A toner for developing latent electrostatic images to visible toner images, comprising toner particles which comprise a thermoplastic resin and a compound with formula (I) serving as a coloring agent:

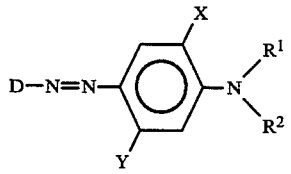

(I)

wherein D represents

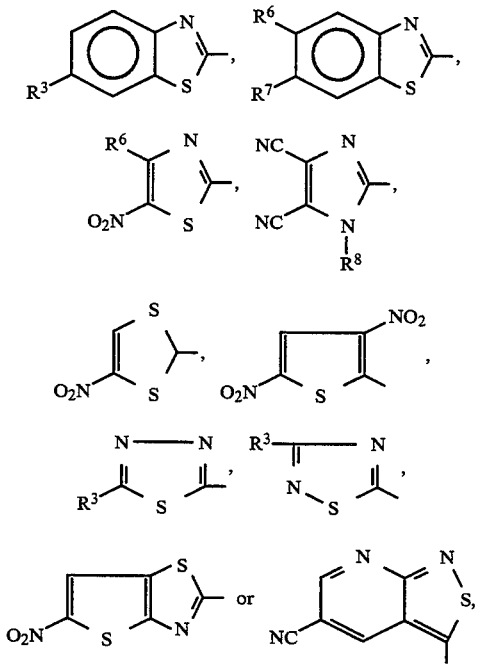

wherein X represents hydrogen, cyano group, an alkyl group having 1 to 4 carbon atoms, an alkoxyl group having 1 to 4 carbon atoms, chlorine, bromine, fluorine, or acetoxy group; Y represents hydrogen, cyano group, an alkyl group having 1 to 4 carbon atoms, an alkoxyl group having 1 to 4 carbon atoms, chlorine, bromine, fluorine, or a group represented by $—NHCOCH_3$, $NHCOC_2H_5$, $—NHCOC_3H_7$, or $—NHSO_2CH_3$; $R^1$, $R^2$ and $R^8$ each represent an alkyl group having 1 to 4 carbon atoms, an alkenyl group having 1 to 4 carbon atoms, a hydroxyalkyl group, an alkoxyalkyl group, a phenoxyalkyl group, a cyanoalkyl group, a chloroalkyl group, a bromoalkyl group, an acyloxyalkyl group, an alkoxycarbonyloxyalkyl group, benzoyloxyalkyl group, a phenoxycarbonyloxyalkyl group, an alkoxycarbonylalkyl group, a phenoxycarbonylalkyl group, a carbonylesteralkyl group, a chlorohydroxyalkyl group, an aryl group, cyclohexyl group, or benzyl group; $R^3$ represents hydrogen, cyano group, nitro group, chlorine, bromine, fluorine, trifluoromethyl group, an alkyl group having 1 to 8 carbon atoms or an alkoxyl group having 1 to 6 carbon atoms; and $R^6$ and $R^7$ each represent hydrogen, an alkyl group having 1 to 6 carbon atoms, cyano group, nitro group, chlorine, bromine, or fluorine.

16. A toner for developing latent electrostatic images to visible toner images, comprising pulverized particles which comprise a thermoplastic resin, said pulverized particles being dyed with a compound with formula (I) serving as a coloring agent:

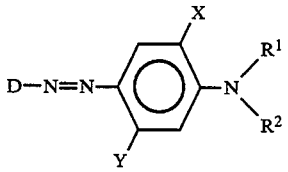

(I)

wherein D represents

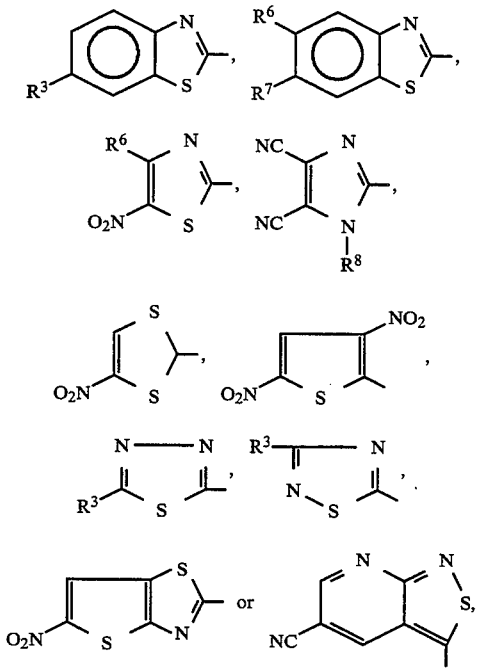

wherein X represents hydrogen, cyano group, an alkyl group having 1 to 4 carbon atoms, an alkoxyl group having 1 to 4 carbon atoms, chlorine, bromine, fluorine, or acetoxy group; Y represents hydrogen, cyano group, an alkyl group having 1 to 4 carbon atoms, an alkoxyl group having 1 to 4 carbon atoms, chlorine, bromine, fluorine, or a group represented by $—NHCOCH_3$, $NHCOC_2H_5$, $—NHCOC_3H_7$, or $—NHSO_2CH_3$; $R^1$, $R^2$ and $R^8$ each represent an alkyl group having 1 to 4 carbon atoms, an alkenyl group having 1 to 4 carbon atoms, a hydroxyalkyl group, an alkoxyalkyl group, a phenoxyalkyl group, a cyanoalkyl group, a chloroalkyl group, a bromoalkyl group, an acyloxyalkyl group, an alkoxycarbonyloxyalkyl group, benzoyloxyalkyl group, a phenoxycarbonyloxyalkyl group, an alkoxycarbonylalkyl group, a phenoxycarbonylalkyl group, a carbonylesteralkyl group, a chlorohydroxyalkyl group, an aryl group, cyclohexyl group, or benzyl group; $R^3$ represents hydrogen, cyano group, nitro group, chlorine, bromine, fluorine, trifluoromethyl group, an alkyl group having 1 to 8 carbon atoms or an alkoxyl group having 1 to 6 carbon atoms; and $R^6$ and $R^7$ each represent hydrogen, an alkyl group having 1 to 6 carbon atoms, cyano group, nitro group, chlorine, bromine, or fluorine.

* * * * *

UNITED STATES PATENT AND TRADEMARK OFFICE

CERTIFICATE OF CORRECTION

PATENT NO. : 5,387,488

DATED : February 7, 1995

INVENTOR(S) : Yoshikazu KANEKO et al

It is certified that error appears in the above-identified patent and that said Letters Patent is hereby corrected as shown below:

Column 18, line 24, "excellent.line" should read -- excellent line--.

Signed and Sealed this

Sixteenth Day of July, 1996

*Attest:*

*Attesting Officer*

Bruce Lehman

BRUCE LEHMAN

*Commissioner of Patents and Trademarks*